US006807738B1

(12) United States Patent
Shih et al.

(10) Patent No.: US 6,807,738 B1
(45) Date of Patent: Oct. 26, 2004

(54) BLADE GRIPPING MECHANISM IN A HEAVY DUTY ARTISTIC KNIFE

(76) Inventors: Shih-Chin Shih, P.O. Box 697, Feng-Yuan City, Taichung Hsien (TW), 420; Yin-Hae Huang, P.O. Box 697, Feng-Yuan City, Taichung Hsien (TW), 420

( * ) Notice: Subject to any disclaimer, the term of this patent is extended or adjusted under 35 U.S.C. 154(b) by 178 days.

(21) Appl. No.: 10/263,749

(22) Filed: Oct. 4, 2002

(51) Int. Cl.[7] ..... B26B 1/04

(52) U.S. Cl. ..... 30/321; 30/329; 16/111.1; 16/436; 74/543

(58) Field of Search ..... 74/543; 16/111.1, 16/436, DIG. 12; 30/321, 329, 330, 335, 337, 339; 81/177

(56) References Cited

U.S. PATENT DOCUMENTS 5,303,474 A * 4/1994 Keklak et al. ..... 30/162
5,603,162 A * 2/1997 Chen ..... 30/162
5,613,300 A * 3/1997 Schmidt ..... 30/2
5,909,930 A * 6/1999 Ragland et al. ..... 30/125
6,314,646 B1 * 11/2001 Schmidt ..... 30/162
6,327,780 B1 * 12/2001 Bigham et al. ..... 30/162
2002/0162229 A1 * 11/2002 Roberts et al. ..... 30/330
2003/0037444 A1 * 2/2003 Chunn ..... 30/337
2004/0045167 A1 * 3/2004 Gringer et al. ..... 30/125

* cited by examiner

*Primary Examiner*—Chong H. Kim

(57) ABSTRACT

A blade gripping mechanism in a heavy duty artistic knife includes a straight handle combined with a first and a second halves and secured by a pair of screws. The straight handle has a tubular projection in front end for elastically disposing a positioning member which has a pair of tenons symmetrically formed on opposing outer peripheries and a rectangular receiving space in rear end for releasably disposing a tool box therein. A head has a first annular ring on rear end sleeved on the tubular projection including two pairs of mortises in an inner flange made engageable with the tenons and an annular gap in communication with a flat gap in the body. A blade rack having a second annular co-axially sleeved on the tubular projection together with the first annular ring and a blade disposing space in side of a flat upright for placing a blade therein. When changing a new blade, press the blade rack downward to have it rotating out of the flat gap and then push it in again after the changing of the blade. The process is therefore simple and convenient.

3 Claims, 7 Drawing Sheets

BLADE GRIPPING MECHANISM IN A HEAVY DUTY ARTISTIC KNIFE

BACKGROUND OF THE INVENTION

The present invention relates to heavy duty artistic knives and more particularly to a blade gripping mechanism in a heavy duty artistic knife.

The blade for heavy duty artistic knife is usually in trapezoid shape which has two triangular edges can reciprocate with each other. Due to the strong force has to be applied on the knife everytime when it cuts a work piece, the edges of the blade are very easily to become obtuse and have to be changed very often. Therefore, improvement has to be made to ensure that the changing of the blade should be very rapid and the gripping of the blade should be very stable. The heavy duty artistic knives available in the market are usually adopted a button to grip the blade. The button can slide the blade to and fro in the handle. Due to the poor gripping force, the blade is always loosened. Besides, each time to change the blade, the handle has to be wholly disassembled, causing great inconvenience.

SUMMARY OF THE PRESENT INVENTION

The present invention has a main object to provide a blade gripping mechanism in a heavy duty artistic knife which mechanism has a rotatable blade rack to be opened easily to facilitate the user to rapidly change or fixedly place the blade.

Another object of the present invention is to provide a blade gripping mechanism in a heavy duty artistic knife in which a tool box is provided to store spare blades or other small tools.

Accordingly, the blade gripping mechanism in a heavy duty artistic knife of the present invention comprises generally a straight handle which is combined with a first and a second halves and secured by screws and has a tubular projection in front end and a rectangular receiving space in rear end, a head which has an annular ring on rear end rotatably sleeved on the tubular projection, an annular gap in the annular ring communicating to a flat gap in the body for receiving a roughly T-shaped blade rack which has a flat bottom, a flat upright engaged within the flat gap of the head and a positioning ring engaged with the annular gap of the annular ring so that the positioning ring is sleeved on the tubular projection together with the annular ring, a blade is placed in a blade disposing space in on side of the upright of the blade rack and stool box releasably disposed into the rectangular receiving space in the rear end of the straight handle for storing spare blades and/or other small toll. When rotates the blade rack downward, it is opened to facilitate a rapid changing of the blade taking from the stool box that is very convenient.

The present invention will become more fully understood by reference to the following detailed description thereof when read in conjunction with the attached drawings.

DETAILED DESCRIPTION OF THE PREFERRED EMBODIMENT

Figure 1:
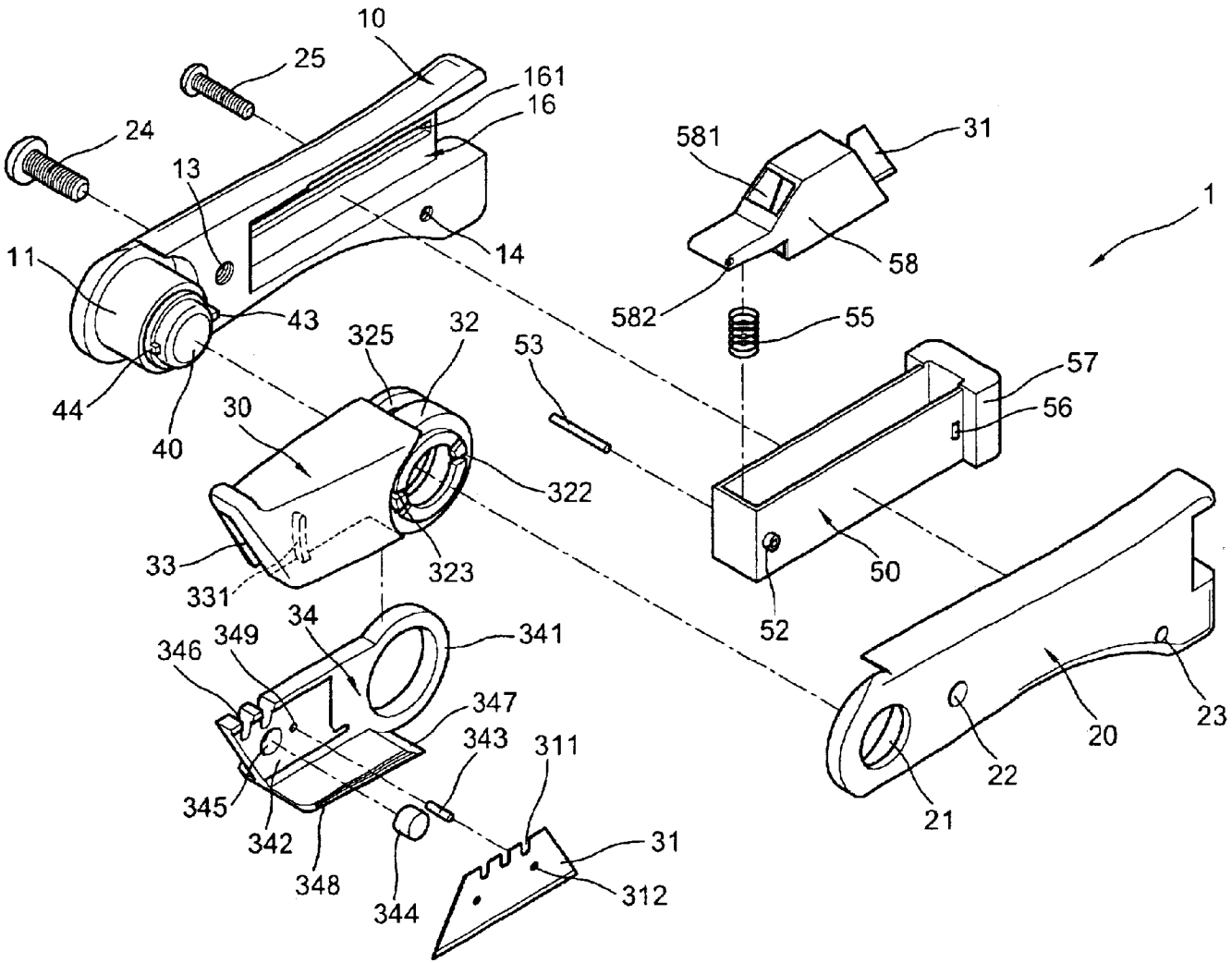
FIG. 1 is an exploded perspective view to show the preferred embodiment of the present invention.
Figure 2:
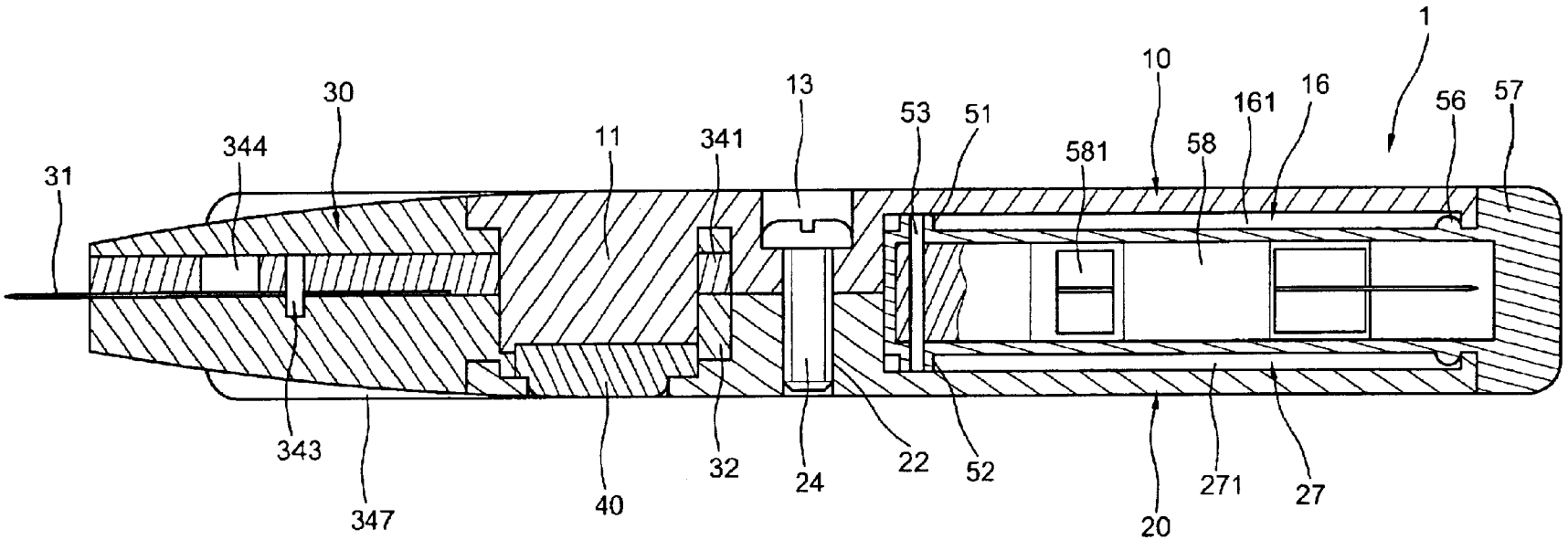
FIG. 2 is a top sectional view to show the assembly of the present invention.
Figure 3:
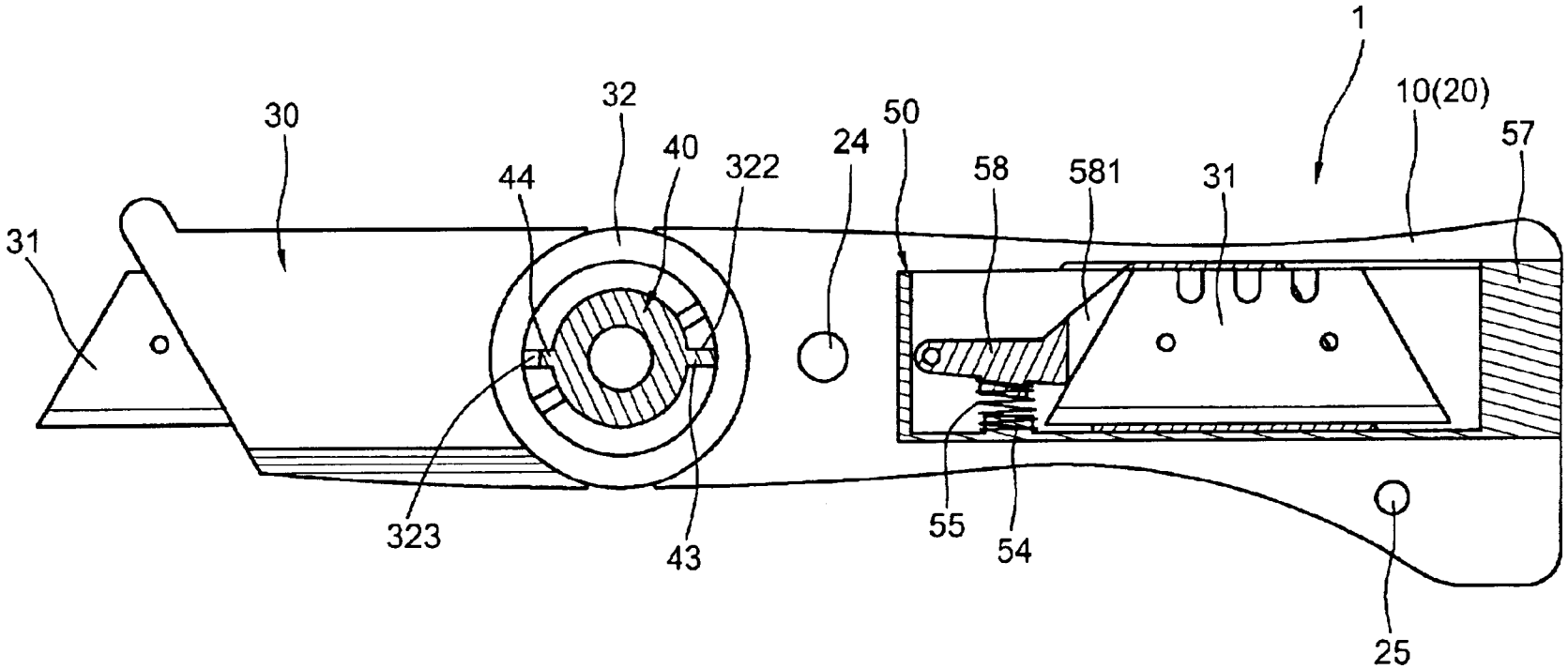
FIG. 3 is a side view with partially sectional view of FIG. 2.

With reference to FIGS. 1, 2 and 3, of the drawings, the blade gripping mechanism in a heavy duty artistic knife of the present invention comprises a straight handle 1, a head 30 and a tool box 50.

The straight handle 1 is combined with a first half 10 and a second half 20 has a tubular projection 11 in front end, a pair of screw hole spacedly formed in the body, a rectangular space 16 in the inner side abutting rear end including a grooved guide 161 extended along the length thereof and a positioning member 40 elastically disposed into the tubular projection 11 having a large tenon 43 and a small tenon 44 symmetrically formed on opposing outer peripheries. The second half 20 has a circular through hole 21 adjacent front end, a pair of screw holes 22 and 23 spacedly formed in the body made in registry with the screw holes 13 and 14 of the first half 10 and a rectangular space 27 formed in the inner side abutting rear end including a grooved guide 271 extended along the length thereof which is made in registry with the rectangular space 16 and the grooved guide 161 of the first half 10 and a pair of screws 24 and 25 secure the first half 10 and the second half 20 together through the screw holes 13, 22 and 14, 23. Once the first and second halves 10 and 20 are combined, the positioning member 40 is engaged with the circular through hole 21 and the rectangular spaces 16 and 27 are formed a large rectangular receiving space to receive the tool box 50 therein (as shown in FIGS. 2 and 3).

Figure 5:
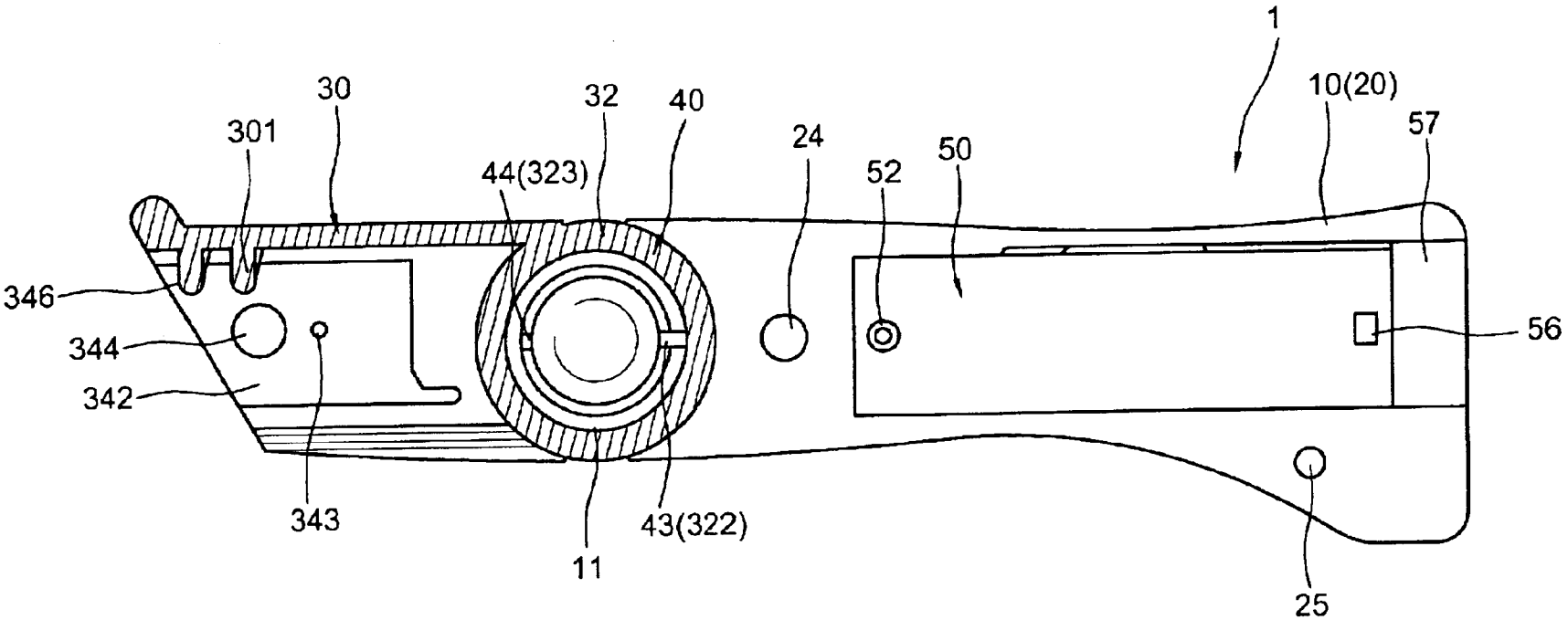
FIG. 5 is a sectional view to show the structure of the head.

The head 30 has an annular ring 32 on rear end sleeved on the tubular projection 11 of the first half 10 including two pairs of mortises 322 and 323 symmetrically formed in opposing inner peripheries made engageable with tenons 43 and 44 (this part was already described in another U.S. Patent application) and an annular gap 325 made in communication with a flat gap 33 in the body of the head 30, a stop block 331 formed on one lateral side of the flat gap 33 and a pair of projections 301 spacedly formed on the top inner surface of the flat gap 33 (as shown in FIG. 5). A roughly T-shaped bladed rack 34 disposes into the flat gap 33 of the head 30. The blade rack 34 flat upright and a flat bottom, an annular ring 341 on the rear end engaged into the annular gap 325 so that the annular ring 341 is sleeved on the tubular projection 11 together with the annular ring 32, a blade disposing space 342 formed in a lateral side of the flat upright including a large recess 345 for receiving a magnet 344, a small recess 349 for receiving a pin 343 therein, a pair of slots 346 spacedly formed in a top of the flat upright made in registry with the projections 301 of the flat gap 33, a sloped surface 347 on the rear end of the flat bottom and a striped surface 348 on a lateral edge of the flat bottom for the purpose of readily opening of the blade rack 34 by finger. A blade 31 disposes into the blade disposing space 342 and is attracted by the magnet 344 and squeezed by the stop black 331 and has a plurality of slots 311 in the top engaged with slots 346 of the blade rack 34 and the protrusions 301 of the head 30 respectively and a pair of through holes 312 engaged on the pin 343.

The tool box 50 is in drawer shaped and has a bottom, two lateral walls, a front wall, an enlarged back wall or grip piece 57 which is larger than the front wall in order to cover the opening end of the large rectangular receiving space and to facilitate finger operating, a pair of tubular protrusions 51 and 52 and a pair of triangular blocks 56 symmetrically and spacedly formed on opposing outer surfaces of the lateral walls which are slidably engaged within the grooved guides 161 and 171 of the rectangular receiving space, a protrudent rod 54 centrally projected upward from the bottom of the tool box 50 adjacent front end thereof for disposing the lower end of a spring 55 (as shown in FIG. 3), a hollow interior tool rack 58 for storing the spare blades 31 or other tools disposed into the tool box 50 and biased by the upper end of the spring 55 and has an oblique surface 581 on a top and a through hole 582 in front end made engageable with the tubular protrusions 51 and 52 of the tool box 50 and rotatably secured by an axial pin 53. So that the tool rack 58 may be jumped up when the tool box 50 is drawn out of the rectangular receiving space. The oblique surface 581 is provided to facilitate the tool box 50 to readily insert into the rectangular receiving space.

When assembling, first dispose the blade rack 34 into the flat gap 33 of the head 30 with the annular ring 341 engaged into the annular gap 325 of the annular ring 32, the sleeve the annular ring 32 together with the annular ring 341 onto the tubular projection 11 of the first half 10 and then combine the two halves 10 and 20 together by screws 24 and 25, finally insert the tool rack 58 into the rectangular receiving space. So that the assembly of the heavy duty artistic knife of the present invention is therefore accomplished. Meanwhile, the tenons 43 and 44 will be automatically engaged with the respective mortises 322 and 323. Further, the blade rack 34 can be individually rotated on the tubular projection 11.

Figure 4:
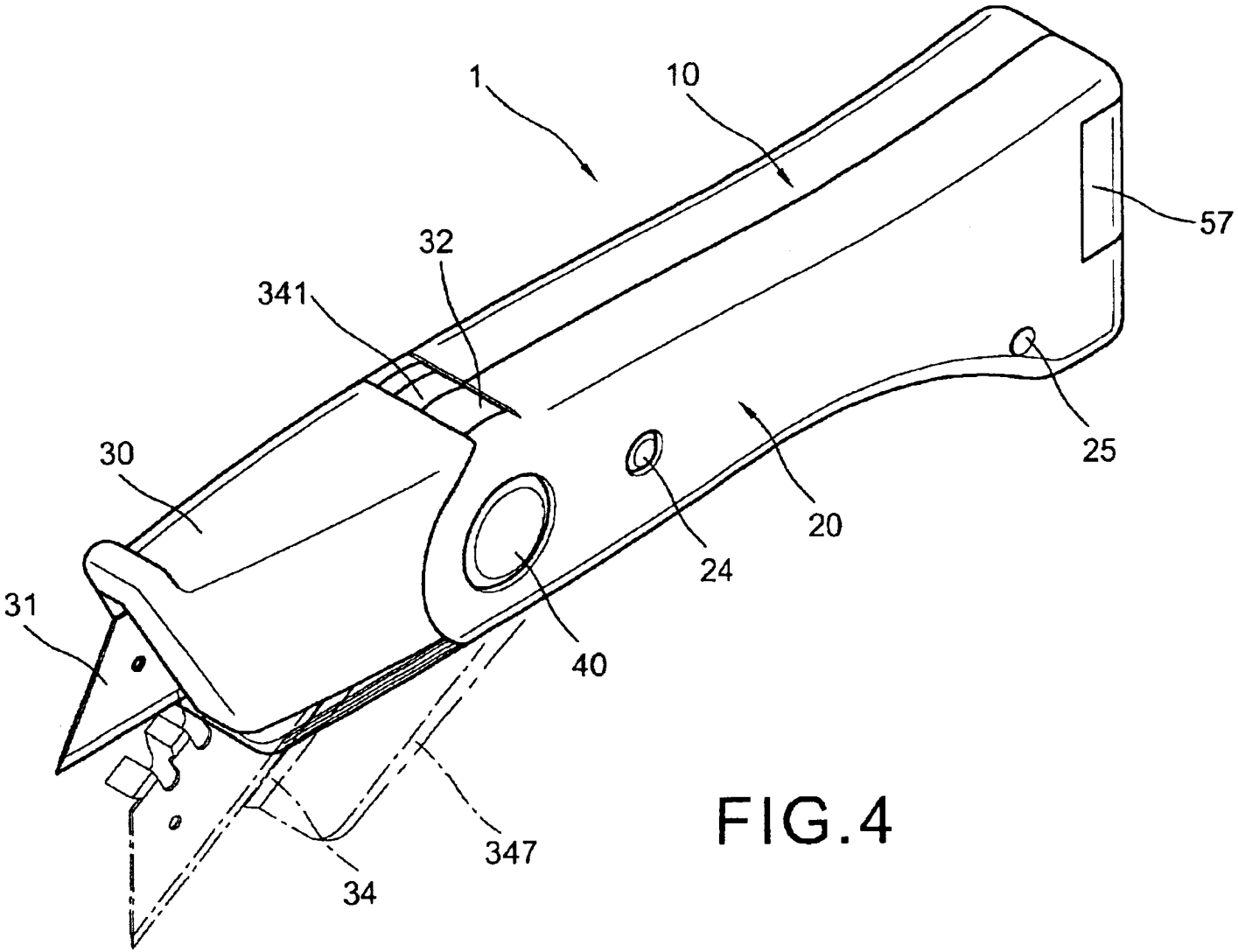
FIG. 4 is a perspective view of FIG. 2 while the artistic knife of the present invention is in operation.
Figure 6:
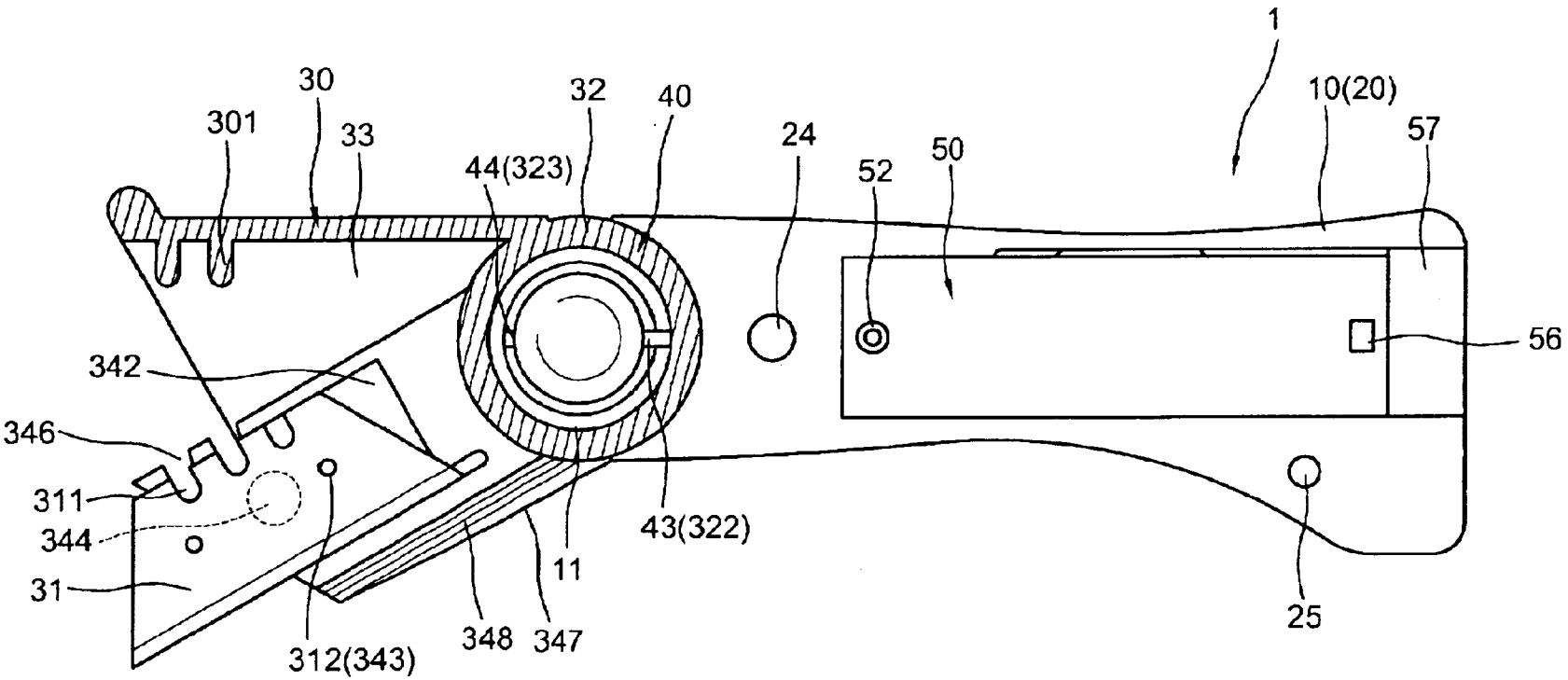
FIG. 6 is a sectional view to show that the blade rack is opened to change the blade.

Referring to FIGS. 4, 5 and 6, of the drawings, if attempt to change or replace a new blade 31 into the blade rack 34, one can press the sloped surface 347 or the striped surface 348 downward to turn the blade rack 34 out of the flat gap 33 of the head 30. Then place the new blade 31 into the blade disposing space 342 in the manner as described the above. When the blade rack 34 upward to frictionally engaged into the flat gap 33, the protrusions 301 in the gap 33 will be automatically engaged with the slots 311 of the blade 31 to limit the lateral movement of the blade 31. In operation, due to an reaction force comes from under edge of the blade 31 that helps the blade rack 34 to be more tight into the flat gap 33 without breaking off. If more gripping mechanism is provided in the flat gap 33 to grip the blade rack 34, it should be within the scope of the present invention.

Figure 7:
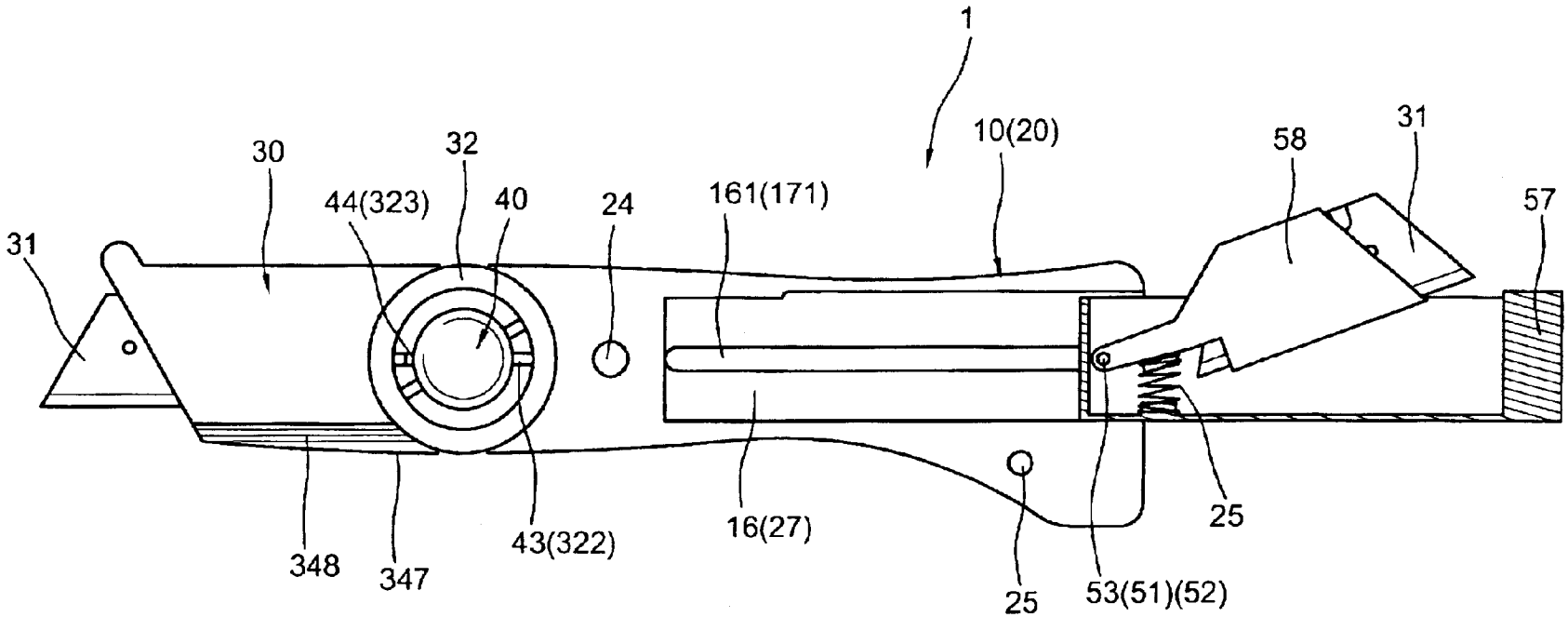
FIG. 7 is a sectional of the tool box which is drawn apart from the straight handle.

Referring to FIG. 7, when apply the grip piece 57 to draw the tool box 50 out of the rectangular receiving space, the free end of the tool rack 58 will be jumped up to facilitate a readily picking up a spare blade 31 or other tools from the tool rack 58.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

We claim:

1. A blade gripping mechanism in a heavy duty artistic knife comprising:

a straight handle combined with a first half and a second half by a pair of screws through two pair of screw holes respectively and spacedly formed in said halves, said halves each having a corresponding rectangular space including a grooved guide extended along the length thereof formed in an inner side abutting rear end to combine a large rectangular space therebetween therein said first half having a tubular projection on an inner side abutting front end thereof to elastically receiving a positioning member which has a pair of tenons symmetrically formed on opposing outer peripheries, said second half having a circular through hole abutting front end made engageable with side positioning member;

a head having a first annular rotatably sleeved onto said tubular projection of said first half and having two pairs of mortises symmetrically and spacedly formed in an inner flange engageable with said tenons of said positioning member and an annular gap formed in said first annular ring communicating to a flat gap inside side head, a stop block on an inner wall of said flat gap and a pair of projections spacedly formed on an inner top of said flat gap;

a T-shaped blade rack having a flat bottom, a flat upright engageable into said flat gap of said head, a second annular ring engaged into said annular gap of said first annular ring of said head so as to co-axially sleeved on said tubular projection of said first half together with said first annular ring, a blade disposing space formed in a lateral side of said flat upright facing said stop black of said flat gap and having a large recess and a small recess spacedly formed therein for respectively disposing a magnet and a pin, a pair of first slots spacedly formed in a top of said flat upright abutting front end thereof made engageable with said projections of said flat gap, and sloped surface on inner end of said flat bottom and a striped surface on a lateral edge of said flat bottom;

a blade engaged into said blade disposing space of said blade rack and attracted by said magnet, said blade having a pair of through hole in the body engageable with said pin of said blade disposing space and a plurality of second slots spacedly formed in top engageable with said first slots of said flat upright and said projections of said flat gap respectively;

a drawer shaped tool box releasably disposed into said rectangular receiving space of said straight handle, said tool box having a bottom, two lateral walls, a front wall and an enlarged back wall, a pair of tubular protrusions and a pair of triangular blocks symmetrically and spacedly formed on opposing outer surface of said lateral walls made slidably engaged into said grooved guides of said rectangular receiving space, a protrudent rod centrally projected upward from an inner surface of said bottom for disposing one end of a spring means, a blade rack for storing spare blades disposed into said tool box and biased by said spring mean, said blade rack having a hollow interior, an oblique surface on a top and through hole in front end made engaged with said tubular protrusions of said tool box and rotatably secured by an axial pin.

2. The blade gripping mechanism as recited in claim 1 wherein said blade rack is rotated individually on said tubular projection for facilitating changing of said blade.

3. The blade gripping mechanism as recited in claim 1 wherein said blade rack is jumped up when said tool box is drawn out of said rectangular receiving space for facilitating picking up a spare blade therefrom.

* * * * *